US005845367A

United States Patent [19]

Vezzoli et al.

[11] Patent Number: 5,845,367

[45] Date of Patent: Dec. 8, 1998

[54] DOUBLE-CYLINDER OPENER AND RELATIVE PROCESS FOR OPENING AND CLEANING STAPLE FIBER BY PROGRESSIVE ACTION

[75] Inventors: Emilio Vezzoli; Giovanni Battista Pasini, both of Palazzolo Sull'oglio, Italy

[73] Assignee: Fratelli Marzoli & C. S.p.A., Bergamo, Italy

[21] Appl. No.: 890,307

[22] Filed: Jul. 9, 1997

[30] Foreign Application Priority Data

Jul. 11, 1996 [IT] Italy ..... MI96A1433

[51] Int. Cl.[6] ..... D01B 1/00

[52] U.S. Cl. ..... 19/85; 19/97.5; 19/200; 19/204; 19/205

[58] Field of Search ..... 19/200, 204, 205, 19/85, 97.5

[56] References Cited

U.S. PATENT DOCUMENTS

| | | | |
|---|---|---|---|
| 2,990,585 | 7/1961 | Sawyer | 19/200 |
| 4,229,286 | 10/1980 | Bridges | 19/200 |
| 4,300,267 | 11/1981 | Winch et al. | 19/200 |
| 4,338,705 | 7/1982 | Jones | 19/200 |
| 4,625,368 | 12/1986 | Leifeld | 19/200 |
| 5,319,830 | 6/1994 | Staheli | 19/205 |
| 5,343,597 | 9/1994 | Pinto et al. | 19/205 |

FOREIGN PATENT DOCUMENTS

| | | | |
|---|---|---|---|
| 751666 | 6/1933 | France . | |
| 1122072 | 3/1956 | France . | |
| 202805 | 12/1906 | Germany . | |
| 269637 | 4/1913 | Germany . | |
| 1-192826 | 7/1989 | Japan . | |
| 283655 | 10/1926 | United Kingdom . | |
| 2000534 | 1/1979 | United Kingdom | 19/85 |

*Primary Examiner*—William Stryjewski
*Attorney, Agent, or Firm*—Diller, Ramik & Wight, P.C.

[57] ABSTRACT

A double-cylinder opener for staple fiber being pneumatically transported in an air stream, the two cylinders being parallel and mutually offset, the fibers passing firstly about the first cylinder and then about the second cylinder with spiral motion, the two cylinders forming two beaters of different action, which rotate at different velocities and are provided with different spike population densities.

26 Claims, 3 Drawing Sheets

DOUBLE-CYLINDER OPENER AND RELATIVE PROCESS FOR OPENING AND CLEANING STAPLE FIBER BY PROGRESSIVE ACTION

BACKGROUND OF THE INVENTION

This invention relates to the opening and cleaning of natural fibres in which the material, suspended in a transporting air stream, is subjected to the action of one or two beaters, by which the staple fibre is opened and reduced to a shorter tuft length, to release and expel the trash, ie dust and foreign material bodies. In particular, the present invention relates to an apparatus and process for opening and cleaning staple fibre by means of a beater opener.

SUMMARY OF THE INVENTION

In the known art openers are available for staple fibre in a transporting air stream using beaters consisting of one or more rotary cylinders provided with beater spikes. Below said cylinders there are located separation grids which retain the fibre tufts but allow the trash to pass, this having separated from the fibres on colliding against said grids or the cylinder spikes. The inlet and outlet openings for the air stream which pneumatically transports the staple fibre are offset axially to the beater cylinder or cylinders so as to achieve a helical fibre path about the cylinder by the effect of said axial component of the motion combined with the tangential thrust of the beater spikes.

The cylinders which form said beaters can be single or double, of right cylindrical or stepped form, or of conical form. The spike clothing can be parallel or inclined to the cylinder radius, and be of either constant or differing Length along the cylinder axis. The spaces surrounding the cylinder or cylinders can be provided with guide walls to regulate the velocity and direction of the pneumatic transport stream for the fibres, hence regulating the residence time and the intensity of the beating action which opens and cleans the processed staple fibre, and finally the separation effect between the trash particles and the fibre tufts. To illustrate more clearly both the technical problems to be solved and the characteristics and advantages of the present invention, it is described hereinafter with reference to some typical embodiments shown in FIGS. 1 to 3 by way of non-limiting example.

DESCRIPTION OF THE PREFERRED EMBODIMENTS

Figure 1:
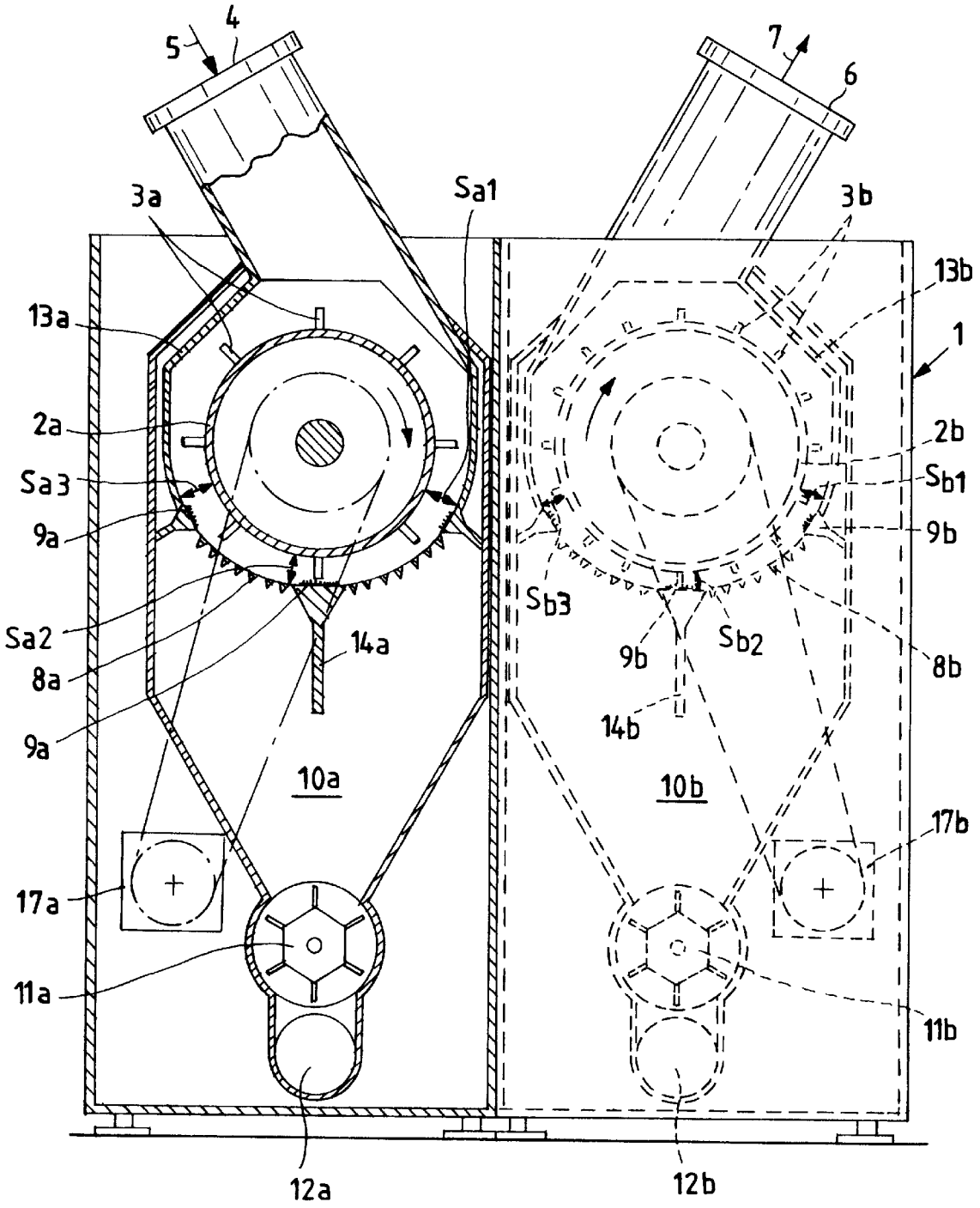
FIGS. 1 to 3 relate to a typical embodiment of the opener according to the invention, FIG. 1 being a front section through its end, FIG. 2 being a view from above without the cover, FIG. 3 being a view of the cylinders from above with their shells shown sectioned, and FIG. 4 being an enlarged detailed view of the carding plates.
Figure 4:
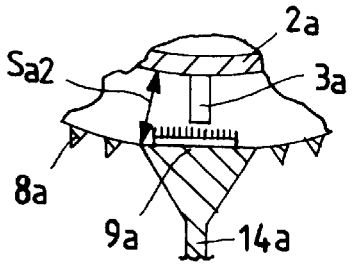
Figure 2:
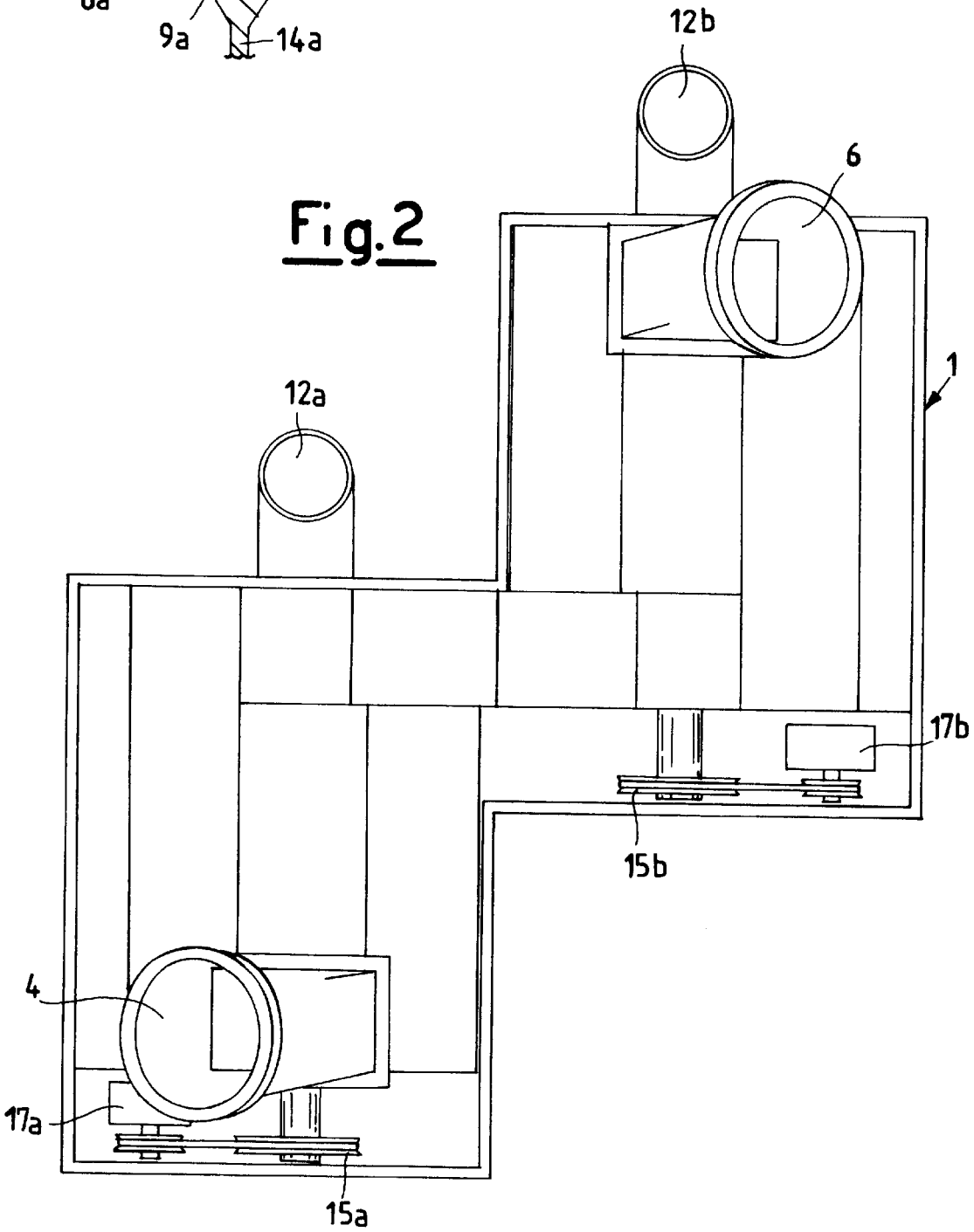
Figure 3:
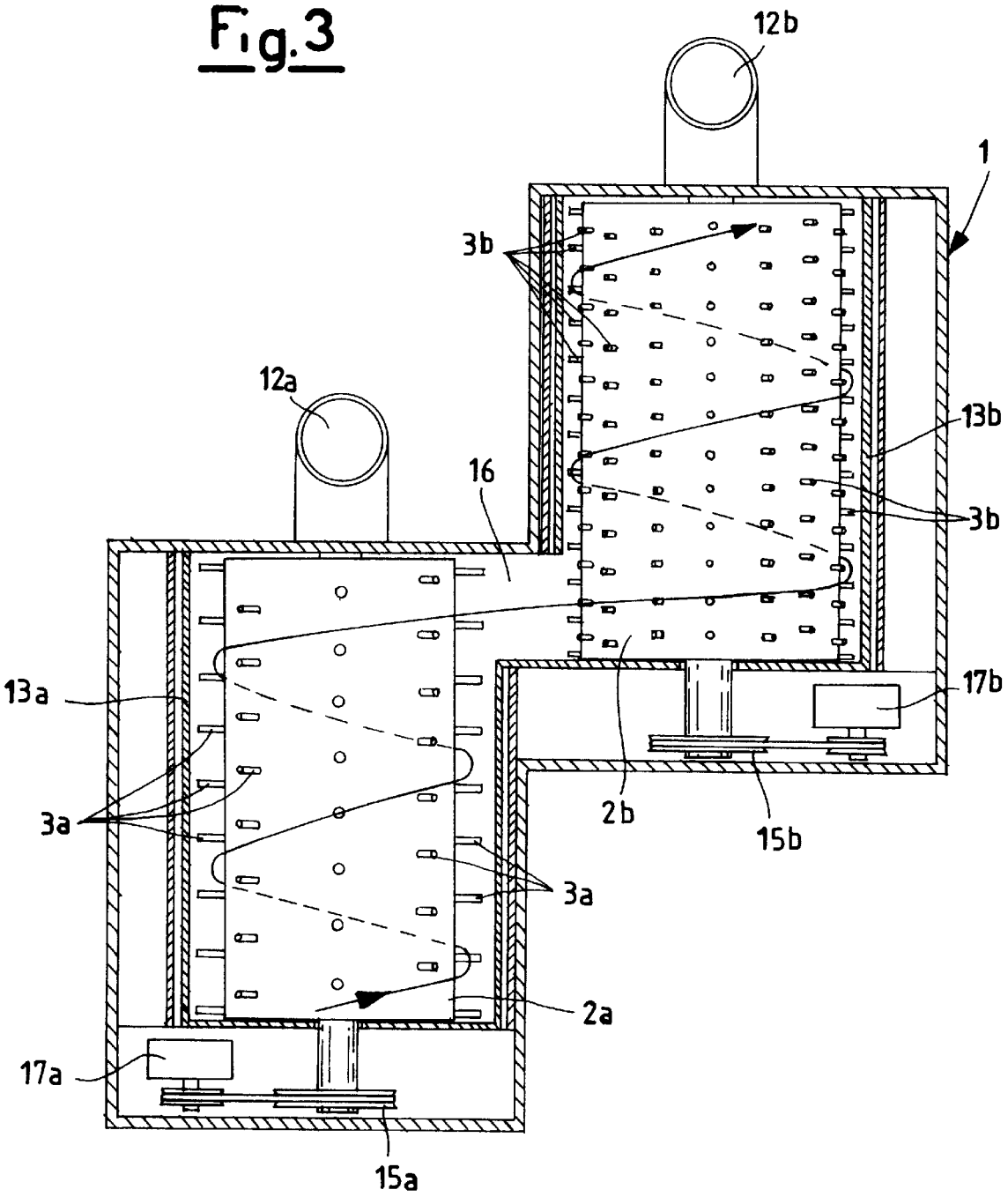

The opener is contained in a support and containing structure 1 for the two cylinders 2*a, b* which form the support for the beater spikes 3*a, b*. On the top left of the structure there is an opening 4 through which a fibre transporting air stream is fed in the direction of the arrow 5, to bring the fibre tufts into contact with the first cylinder 2*a*. On the top right of the structure there is an opening 6 through which the fibre transporting air stream is withdrawn in the direction of the arrow 7 to discharge opened fibre tufts which have been cleaned by the effect of the contact with the beaters, firstly with the first cylinder 2*a* and then with the second cylinder 2*b*. The conduits associated with the openings 4 and 6 are preferably positioned at the two ends of the structure in such a manner as to direct the transporting streams in directions 5 and 7 which are vertical and tangential to the underlying beater. Each of the cylinders 2*a, b* is surrounded in its lower part by a grid 8*a, b* of longitudinal bars, for example of triangular or square cross-section and preferably with sharp edges, which does not allow passage of the staple material which comes into contact with it during its spiral motion, but allows passage of the trash which is released from the fibre tufts when opened by the beaters.

In a preferred embodiment of the invention, to increase the separation action on the trash by the grid 8, the staple material can be additionally opened by fixed carding plates 9*a, b* positioned at the entry to and exit from the grids, between the longitudinal bars. The fixed carding plates 9*a, b* positioned in correspondence with the grids 8 hence cooperate with the action of the cylinders 2*a, 2b*. Optionally, the exit carding plate can be installed only for the first of the two cylinders.

The dust and foreign material bodies, generally heavier and more compact than the fibres, fall below the grids 8*a, b* and deposit on their triangular base 10*a, b*, from which they are withdrawn, for example by transportation in an air stream which discharges them into the lower part of the machine, or by a screw device, the suction and discharge being controlled for example by a bladed valving element 11*a, b*. This discharge can be continuous or occasional through their pipe 12*a, b*, maintaining the level of accumulated material in the base 10 under control.

The fibre tufts do not pass below the grid 8*a, b*, but are conveyed away from it by the action of the transport air, which moves in a helical path within the cavity between the cylinder and grid. In a preferred embodiment of the present invention, the grid is prolonged upwards and outwards by non-perforated directional lead-in cowlings 13*a*, 13*b* for the spiral flow of the transport air, so that the distance of the surface of the cylinder 2*a, b* from the upper surface of its grid 8*a, b* and from its cowling 13*a, b* is progressively reduced in the direction of rotation, to cause the air stream, at each revolution, to accelerate in its path transverse to the grid when at the grid 8, for example by determining the distances s between the cylinder and grid with the following criteria: Sa1≧Sa3>Sa2, where Sa1 corresponds to the grid entry, Sa2 corresponds to the grid centre on the beam 14*a, b* supporting the grids, and Sa3 corresponds to the grid exit. Using the same notation the corresponding relationship for the second grid is hence Sb1≧Sb3>Sb2.

This acceleration intensifies the impact of the tufts with the grid 8*a, b* and with the carding plates 9*a, b*, to increase the cleaning effect on the fibres and facilitate withdrawal of the fibre tufts after their collision with the grid, by which the trash fraction removed from the fibre tufts is separated. The cylinders 2*a, b* are hence preferably mounted eccentric to the working cavity which contain's them, and defined lowerly by their particular grid 8 and upperly by their particular cowling 13. According to a further improvement, this eccentricity can be adjusted at any required time or the various processing runs, for example by changing the horizontal distance between the two support shafts for the cylinders 2*a, b*, by shifting them along two adjustment slots provided in their supports in correspondence with the end walls of the structure 1, these not being shown in the figures for simplicity.

An important characteristic of the present invention lies in the fact that the two cylinders 2*a* and 2*b* are arranged with their axes horizontal and parallel, but mutually offset so that the fibres are firstly compelled to pass along a spiral path about the cylinder 2*a* to reach a transfer region 16 between the two cylinders in which the staple fibre stream, which has passed about the cylinder 2*a* and has been subjected to its action, is passed to the subsequent cylinder 2*b* along a passage path of "spectacles" form.

According to a preferred embodiment of the present invention, the cylinders are right cylinders of identical size and lie axially side by side. The length of the axial portion common to the two cylinders, in correspondence with the final section of the first cylinder 2*a* and the initial section of the second cylinder 2*b* with reference to the direction of movement of the material—in which the fibre tufts pass from the first to the second cylinder—is between 5% and 40% of the length of each cylinder. The parallel axes of the two cylinders preferably lie in the same horizontal plane.

A further important characteristic of the present invention lies in the fact that the constituent beater spikes of the two cylinders 2*a* and 2*b* have a different population density. The first cylinder 2*a* has a smaller number of spikes than the cylinder 2*b* and is rotated at a lesser velocity than the cylinder 2*b*. This can be achieved, for example, by rotating the two cylinders with two separate motors 17*a, b* and transmitting their movement to the cylinders by a belt/pulley system 15*a, b*.

The population density of the constituent spikes of the two beaters is between 50 and 100 spikes per $m^2$ for the first cylinder 2*a* and between 100 and 200 spikes per $m^2$ for the second cylinder 2*b*. The cylinder peripheral velocities increase from the first to the second cylinder and preferably lie in the range of 10–20 m/sec for the cylinder 2*a* and in the range of 20–40 m/sec for the cylinder 2*b*. The length of the spikes forming the beaters lies within the range of 10–100 mm and preferably 40–80 mm.

At the end of its spiral path about the cylinder 2*a*, the staple fibre stream passes to the cylinder 2*b* where it undergoes a more intense opening and cleaning action than that of the cylinder 2*a*, because the spikes 3*b* of the cylinder 2*b* are more dense and considerably faster, resulting in a larger number of collisions at a higher speed. The bars of the grid 8*b* are also much more densely arranged than those of the grid 8*a*. In this respect the grid 8*b* has to separate fibre tufts and trash in which the tuft size is much smaller than that to be separated by the grid 8*a*. The pneumatic fibre transport stream then proceeds with a spiral path about the cylinder 2*b* until the discharge opening 6.

This differential action of the two cylinders which process the fibres rigorously in sequence results in considerable advantages. Processing proceeds on the cylinder surfaces so that the fibre tufts become progressively reduced in size as they open, to produce a much greater number of smaller fibre tufts, of lower mass and increasingly more difficult to open to enable the undesirable trash to escape from them. The apparatus of the invention satisfies the requirement of grading the opening and cleaning action according to the staple fibre size, to the required degree of opening, to the quantity of trash contained and to its resistance to removal.

The opening and cleaning process can be easily adjusted according to the fibre batch to be processed at any given time, by varying the residence time in each of the two processing stages, the intensity of action of the beaters and the axial and tangential components of the fibre motion. These process modifications do not involve substantial modifications to the opening device.

Although a preferred embodiment of the invention has been specifically illustrated and described herein, it is to be understood that minor variations may be made in the apparatus without departing from the spirit and scope of the invention, as defined the appended claims.

We claim:

1. A device for opening and cleaning fibres comprising first and second cylinders rotating about respective first and second horizontal axes disposed in substantially parallel relationship to each other, first and second spikes carried by said respective first and second cylinders to define therewith respective first and second fibre tuft opening beaters, said first and second beaters being housed in adjacent respective first and second cowlings having respective first and second grids, a fibre feed opening associated with one of said cowlings and a fibre discharge opening associated with another of said cowlings, said first and second beaters each having axially opposite first and second axial end portions, and said first and second beaters being in axially offset relationship to each other such that the first axial end portion of said first beater is in radially adjacent overlapping opposing relationship to the second axial end portion of said second beater thereby defining a substantially radial fibre transfer region between said beaters through which fibre flows from said first beater first axial end portion to said second beater second axial end portion.

2. The opening and cleaning device as defined in claim 1 wherein said fibre feed opening is associated with said first cowling and said fibre discharge opening is associated with said second cowling.

3. The opening and cleaning device as defined in claim 2 wherein said overlapping opposing axial end portions of said beaters range substantially between 5% to 40% of the length of each cylinder.

4. The opening and cleaning device as defined in claim 3 wherein said first and second spikes vary in density relative to each other as measured with respect to the surface area of the respective first and second cylinders.

5. The opening and cleaning device as defined in claim 2 wherein said first spikes differ in number from said second spikes.

6. The opening and cleaning device as defined in claim 2 wherein said first spikes are smaller in number from said second spikes.

7. The opening and cleaning device as defined in claim 1 wherein said fibre feed opening is associated with said first cowling and said fibre discharge opening is associated with said second cowling, said fibre feed opening is disposed adjacent said first beater second axial end portion, and said fibre discharge opening is disposed adjacent said second beater first axial end portion.

8. The opening and cleaning device as defined in claim 7 wherein said overlapping opposing axial end portions of said beaters range substantially between 5% to 40% of the length of each cylinder.

9. The opening and cleaning device as defined in claim 8 wherein said first and second spikes vary in density relative to each other as measured with respect to the surface area of the respective first and second cylinders.

10. The opening and cleaning device as defined in claim 7 wherein said first spikes differ in number from said second spikes.

11. The opening and cleaning device as defined in claim 7 wherein said first spikes are smaller in number from said second spikes.

12. The opening and cleaning device as defined in claim 1 wherein said overlapping opposing axial end portions of said beaters range substantially between 5% to 40% of the length of each cylinder.

13. The opening and cleaning device as defined in claim 1 wherein said first spikes differ in number from said second spikes.

14. The opening and cleaning device as defined in claim 1 wherein said first spikes are smaller in number from said second spikes.

15. The opening and cleaning device as defined in claim 1 wherein said first and second spikes vary in density relative to each other as measured with respect to the surface area of the respective first and second cylinders.

16. The opening and cleaning device as defined in claim 1 wherein said first and second spikes vary in density relative to each other as measured with respect to the surface area of the respective first and second cylinders, said first spikes have a density of substantially 50 to 100 spikes per $m^2$ of said first cylinder surface area, and said second spikes have a density of substantially 100 to 200 spikes per $m^2$ of said second cylinder surface area.

17. The opening and cleaning device as defined in claim 1 wherein said first and second cylinders are disposed eccentrically with respect to the respective first and second cowlings.

18. The opening and cleaning device as defined in claim 1 wherein said first and second cowlings include respective first and second lower substantially cylindrical walls defining said respective first and second grids, and said first and second cylinders are disposed eccentrically with respect to the respective first and second cowlings and closest to lowermost portions of said respective first and second grids.

19. The opening and cleaning device as defined in claim 1 including first and second fixed carding plates associated with the respective first and second grids.

20. A method of opening and cleaning fibres comprising the steps of introducing fibres into a first end of a substantially closed first volume, subjecting the fibres to a plurality of first rotational cleaning forces while advancing the fibres along the substantially closed first volume in a first direction toward a second end thereof, discharging trash removed from the fibres outwardly of a lower portion of the first closed volume, radially transferring the fibres from the first volume second end into a first end of a substantially closed second volume, subjecting the fibres to a plurality of second rotational cleaning forces while advancing the fibres along the substantially closed second volume in the first direction beyond the first closed volume second end toward a second end of said second closed volume, discharging trash removed from the fibres outwardly of a lower portion of the second closed volume, and discharging fibres from said second closed volume second end.

21. The method of opening and cleaning fibres as defined in claim 20 wherein the first-mentioned rotational cleaning forces are at a lower velocity than the second rotational cleaning forces.

22. The method of opening and closing fibres as defined in claim 21 wherein the first rotational cleaning forces have a peripheral velocity substantially in the range of 10–20 m/sec. and the second rotational cleaning forces have a peripheral velocity substantially in the range of 20–40 m/sec.

23. The method of opening and closing fibres as defined in claim 21 including the step of accelerating circumferential air flow in both volumes in directions toward associated trash discharge.

24. The method of opening and closing fibres as defined in claim 21 including the step of accelerating circumferential air flow in both volumes in directions toward associated trash discharge.

25. The method of opening and closing fibres as defined in claim 20 wherein the first rotational cleaning forces have a peripheral velocity substantially in the range of 10–20 m/sec. and the second rotational cleaning forces have a peripheral velocity substantially in the range of 20–40 m/sec.

26. The method of opening and closing fibres as defined in claim 20 including the step of accelerating circumferential air flow in both volumes in directions toward associated trash discharge.

* * * * *